United States Patent [19]

Mäkipirtti et al.

[11] 4,006,013

[45] Feb. 1, 1977

[54] PROCESS FOR REFINING CARBONACEOUS ALLOYS OF IRON, NICKEL AND/OR COBALT

[75] Inventors: Simo Antero Iivari Mäkipirtti, Nakkila; John Henrik Relander, Pori, both of Finland

[73] Assignee: Outokumpu Oy, Finland

[22] Filed: Apr. 29, 1975

[21] Appl. No.: 572,905

Related U.S. Application Data

[63] Continuation of Ser. No. 422,546, Dec. 6, 1973, abandoned.

[30] Foreign Application Priority Data

Dec. 28, 1972 Finland ..... 3685/72

[52] U.S. Cl. ..... 75/130.5; 75/59

[51] Int. Cl.[2] ..... C22C 39/14

[58] Field of Search ..... 75/130.5, 59, 113

[56] References Cited

UNITED STATES PATENTS

| | | | |
|---|---|---|---|
| 498,061 | 5/1893 | Hunter | 75/59 |
| 1,322,511 | 11/1919 | Armstrong | 75/126 A |
| 1,426,054 | 8/1922 | Estabrooke et al. | 75/59 |
| 1,727,282 | 9/1929 | Gill | 75/126 A |
| 2,174,281 | 9/1939 | Gill | 75/126 A |
| 3,199,976 | 8/1965 | Dammer et al. | 75/59 |
| 3,484,232 | 12/1969 | Karinthi et al. | 75/59 |
| 3,640,702 | 9/1959 | Karinthi et al. | 75/59 |

FOREIGN PATENTS OR APPLICATIONS

| | | | |
|---|---|---|---|
| 977,105 | 12/1964 | United Kingdom | 75/59 |

*Primary Examiner*—M. J. Andrews

*Attorney, Agent, or Firm*—Brooks Haid Haffner & Delahunty

[57] ABSTRACT

In a process for purifying carboniferous iron, nickel and/or cobalt alloys in which the base metal tends to form a carbide, a mixture of at least one halogen and hydrogen is added to the metal melt in order to remove in the form of halides the metals present as impurities.

10 Claims, 5 Drawing Figures

HALIDE – HYDROGEN – BALANCES $P_{MeX_x} = F(a_{Mc}, P_{Hi})$
X = F, Cl, Br, I
x = 1, 2, 3, 4
$a_{Cr} = 9,5 = 10^{-3}$
$a_{Fc} = 2,0 = 10^{-1}$
$a_{Mc}$ = NMc
t = 1600 °C

PROCESS FOR REFINING CARBONACEOUS ALLOYS OF IRON, NICKEL AND/OR COBALT

CROSS REFERENCE TO RELATED APPLICATION

This application is a continuation of our prior copending application Ser. No. 422,546, filed Dec. 6, 1973, and entitled PROCESS FOR REFINING CARBONACEOUS IRON TRIAD ALLOYS now abandoned.

BACKGROUND OF THE INVENTION

1. Field of the Invention

The invention relates to the field of refining smelts of alloys containing iron, nickel and/or cobalt in which the base metal tends to form a carbide.

2. Description of the Prior Art

The use of halogens, e.g. F, Cl, for purifying aluminum is well known. The processes taking place in a gaseous state by using chlorine are mainly based on the decomposition of monochloride, which is stable at high temperature, into trichloride and metallic aluminum (molten) at a low temperature. Some of the impurities are removed even in the evaporation-condensation treatment. Numerous inventions have been made for removing calcium and magnesium from the gas ($AlCl_3$) or gas mixture. The term "iron triad" is used to refer to the three metals, iron, cobalt and nickel, because of their proximity in the periodic table of elements and their somewhat similar properties. The processes are based on the condensation of these metals under temperature conditions corresponding to the lowest possible vapor pressures of their chlorides, in which case the components condensating separate solid or molten or by dissolving in salt melts. Thermal fluoride treatment is also used as analogous to chloride treatment. A suitable process for removing magnesium is to treat a mixture of aluminum and magnesium fluoride at a high temperature, (1450°–1600° C), at which time aluminum monofluoride and magnesium vapors are produced. When the gas temperature is lowered slowly, magnesium-free aluminum melt and magnesium fluoride are produced as a result of a reaction inverse to the former. The other impurities (Fe, Ti, Si, etc.) remain in the residue after the evaporation. The purification of molten aluminum (Mg, Na, etc.) can be carried out by using a molten salt, in which case the impurities are halogenated with a halogen separated from the salt or with a separately added halogen. The impurity halides and the produced aluminum halides are dissolved in the molten salt ($NaAlCl_4$, $MgCl_2$, $2AlCl_3$, alkali chlorides, earth alkali chlorides, and fluorides).

The purification of impure molten magnesium can also be carried out with a salt melt. In this case the salt melt is usually at the bottom of the purification chamber or chambers, and the molten magnesium flows above the salt slag.

Chlorination is also used for purifying molten cement copper while protecting it with a molten salt ($Na_3AlF_6$), in which case the impurities of the molten metal are evaporated.

The halogenation of hard-metal carbides can take place at a low temperature (1000° C) by a total chlorination ($Cl_2 + CO_2$), in which case W, Ta, Nb, Ti, etc. can be separated as chlorides from the binding material and carbon. The process for removing impurities from carboniferous materials (Ti-containing) by chlorinating ($Cl_2$ + air) them as chlorides obviously belongs to the same group.

In the previously known processes for halogenating ferrous alloys (Fe-W, Fe-Nb, Fe-Cr) the aim is mainly a total evaporation at a low temperature ($FeCl_3$, $TaCl_5$, $NbCl_5$, $WCl_5$, $CrCl_2$) and a fractional distillation of the obtained products of evaporation (Nb-Ta separation, etc.). In addition to halogens, molten salts are also used as halogenating agents.

The object of the purification of ferrochromium and ferrous silicon, in both a molten and a solid stage, has often been mainly the removal of carbon, hydrogen, oxygen, and nitrogen, usually in a vacuum process. As a common process for melts we can mention the process in which a $CaF_2 + Na_2CO_3$ mixture is injected into a melt, and the produced NaF removes both the impurities and the gases from it. Chlorination has also been used for the removal of the impurities (Ca, Al) from ferrous silicon in a molten state, although the sulfide melt-slag separation (Ti, Al, etc.) is also being developed further.

It can be said in general concerning the processes, based on halogenation, for metals or metal alloys that there is a multitude of methods developed especially for light metals. The halogenation is carried out by using either elemental halogens (F, Cl) or single or double salts formed by them with alkali metals, earth alkali metals, aluminum, etc., or salt mixtures. A salt mixture is also often used for dissolving and recovering the impurity halide or the basic metal halide. The processes for refining both light and heavy metals often include the halogenation of the metal to be refined, together with its impurities, and a fractional distillation thereafter. The halogenation of ferrous alloys usually takes place in a molten state, and thereby at a low temperature. On the other hand, there are most likely very few actual processes for halogenating heavy metal melts.

SUMMARY OF THE INVENTION

According to the invention there is now presented a novel process for refining iron triad alloys, especially ferro-chromium for the removal and recovery of metal impurities therein. This is achieved by treating iron triad alloy smelt with hydrogen and at least one halogen, e.g. $Cl_2$, HF, HCl, HBr, and HI.

DESCRIPTION OF THE PREFERRED EMBODIMENTS

Figure 1:
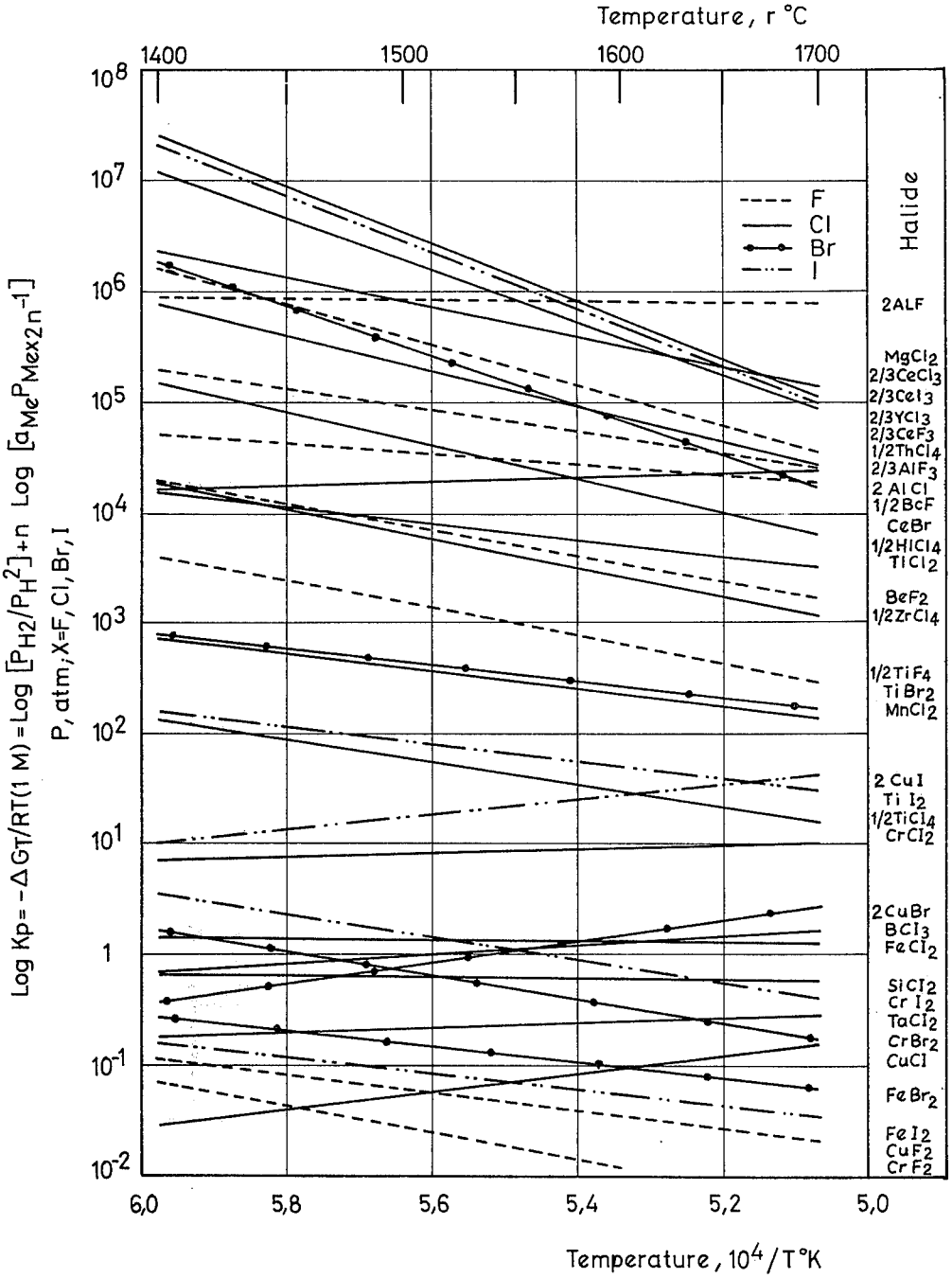

The impurity metals in ferrochromium originate in the raw materials used for its production, i.e. mainly chromite ores, slag additions, coke, scrap metal, etc. The metals covered by the process mainly belong to groups I*a*–VII*a* in the periodic table, although some metals also belong to groups I*b* and IV*b*. The basic metals of ferrous alloys belong to groups V*a* and VI*a* (among others, Nb, Ta, Cr, Mo, W) and to the iron triad (Fe, Co, Ni).

Some of the impurity metals to be discussed are very harmful (e.g., Ti and Zr) in the further refinement of ferrochromium. Some other impurities do not constitute an actual harm in ferrochromium refinement. The latter metals are often valuable in themselves, so that their recovery often covers the expenses caused by the refinement of ferrous alloys.

The new process comprises a selective halogenation of a ferrous alloy in a molten state. As a result, the halides produced from the impurity metals are evaporated or form a molten salt slag which separates from the molten metal. In both cases the halides produced can be recovered.

The selectivity of halogenation requisite for preventing or decreasing halide formation of basic metals is obtained in the process mainly by the following means:

A ferrous alloy is treated with a gas mixture which contains a sufficient amount of hydrogen in addition to the halogen. The production of multiatomic halides, which are often produced and evaporated even at a low temperature, is then easily prevented. Hydrogen pressure control is used to affect the balance state of halide formation, in which case the formation of a halide even slightly more negative by its free energy than hydrogen halide is strongly decreased.

The activity of the basic metals of the ferrous alloy in the melt is lowered so much that its halide formation is prevented or strongly decreased. In a ferrochromium melt a sufficient decrease of the activity of the basic metal (Cr) is obtained by using highly carboniferous or carbon-saturated melt mixtures.

Halogen types or their mixtures which are selective in regard to halide formation of different metals are used in the presence of hydrogen. The halogen mainly meant to be used in the process is chlorine, but the use of fluorine, bromine, and iodine, often partially, is well-founded in special cases.

According to the process, the operation conditions of this new exothermal refinement process can be varied in very many different ways, and also the contents of the valuable and/or harmful components in the final product phases can be regulated.

Thus, in the process according to the invention, the harmful and/or valuable, mainly metallic, impurities present in molten ferrochromium are removed by halogenating the melt selectively. The produced halides are removed from the ferrochromium melt either by evaporation, by forming a salt melt slag, or by dissolution in a synthetic salt melt.

The theoretical grounds for the new process are discussed briefly below. When a ferrochromium melt is treated with an elemental halogen gas, almost all metals with the exception of carbon, and thus also chromium and iron, are halogenated from the melt. The process according to the invention is, however, based on a selective halogenation in which, among other things, the formation of halides of iron and chromium is prevented or their amount is decreased by strongly lowering the activity of chromium in the ferrochromium and by simultaneously using a hydrogen addition together with an elemental halogen gas. The control of the activity of chromium is carried out by controlling the carbon content of the melt.

The halogenation of melt can be illustrated with the equation (1)

$$nMe(l) + 2HX \quad nMeX_{2n}-1, (g, l) + H_2 (g),$$

in which X is a halogen (i.e., F, Cl, Br, I) and $n$ is a coefficient which determines the atomic number of the halogen in the halide (usually 2/5, ⅔, ½1, or 2).

According to the known laws of thermodynamics the balance constant of reaction equation (1) is obtained from the equation (2)

$$\log kp = -\Delta G/RT(1/M = \log \left[ p_{H_2}/P^{\circ}_{HX} \right] + n \left[ a_{Me} P_{MeX_{2n}-1} \right] \quad (2)$$

The balance constants of the reactions corresponding to the halogenation of certain elements have been calculated as functions of temperature on the basis of known thermodynamic functions and are given in FIG. 1.

It can be noted from FIG. 1 that when, for example, an equimolar gas mixture $Cl_2 + H_2$ is used, the balance state according to equation (1) in regard to iron and chromium is still very strong in terms of chloride production (1600° C: $CrCl_2$, kp = 9.08 and $FeCl_2$, kp = 1.35). The formation of chromium chloride can be decreased according to equation (1) either by raising the $H_2/Cl_2$ ratio in the feed gas or by lowering the activity of chromium in the ferrochromium melt.

It is known that the carbon present in the ferrochromium melt very strongly lowers the activity of molten chromium. The isoactivity curves of chromium with different values of chromium and carbon saturation in the ferrochromium melt have been calculated and are given in FIG. 2. The chromium activities in the figure have been calculated from the known equation (3)

$$a_{Cr} = N_{Cr}[\exp - 20.73 \times N_{Cr} \times N_C/(1-N_C)^2]$$

The carbon saturation rates of the ferrochromium melt have been calculated from the known carbon solubility equation (4)

$$N_{C,\,max} = 0.25\, N_{Cr} + \exp[-29.312/T + 0.7266\ \ln T - 7.0209]$$

In the equations, $N_{Cr}$ and $N_C$ are the molar ratios of chromium and carbon, and T is the temperature, °K.

Figure 2:
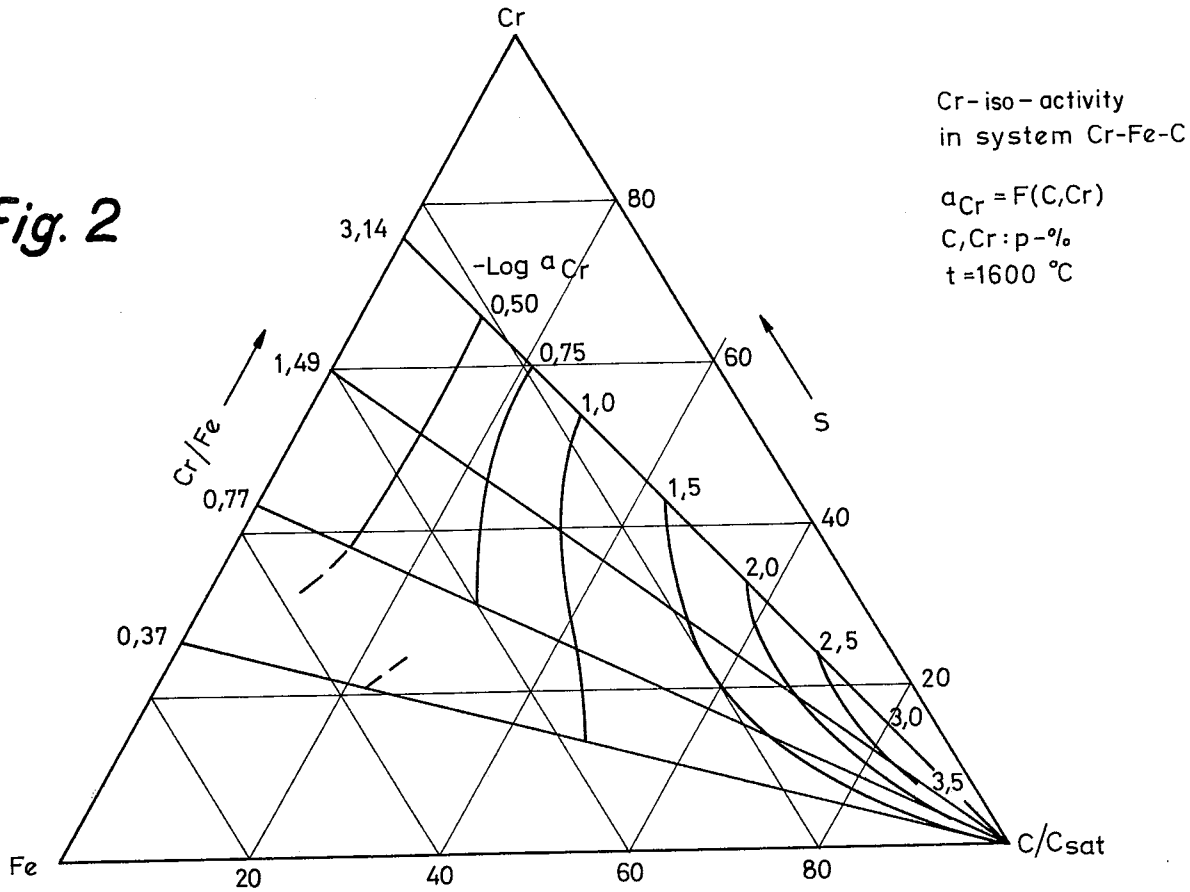
Figure 3:
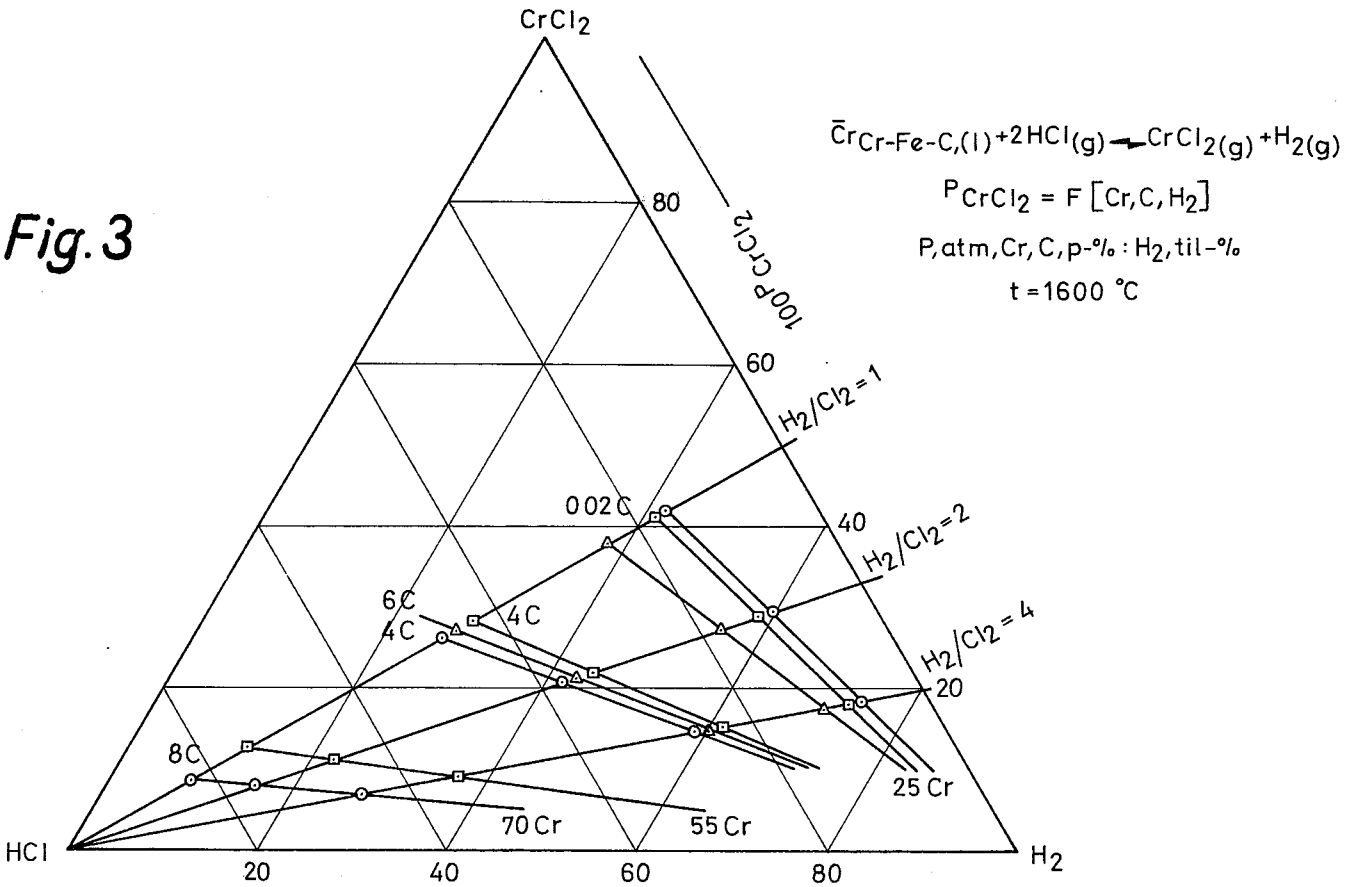

FIG. 2 shows the strongly lowering effect of carbon (rates: C 8, 6, 4, 2, and 0.02 %) on chromium activity; this effect still grows when the chromium content of the melt increases. FIG. 3 shows the gas phase balance corresponding to equation (1), drawn by using the chromium activities in FIG. 2, when ferrochromium melt is treated at the temperature of 1600° C with a gas mixture which contains a rate of hydrogen equimolar to or higher than that of chlorine. According to FIG. 3, the effect of carbon on the balanced $CrCl_2$ rate is very strong. The lowest $CrCl_2$ rate is obtained when the melt has been saturated with carbon. It is also noteworthy that when the chromium rate of the melt lowers from Cr 70 % to 55 %, the chromium chloride pressure of the gas phase does not grow strongly. When the carbon content of the melt lowers much below the saturation value, high rates of hydrogen are required for preventing the chlorination of the chromium out of the melt.

The balance constant of iron chloride formation is lower than that of chromium chloride, but its proportional production is slightly greater than that of the latter because carbon does not lower the activity of iron as much as it does that of chromium.

Figure 4:
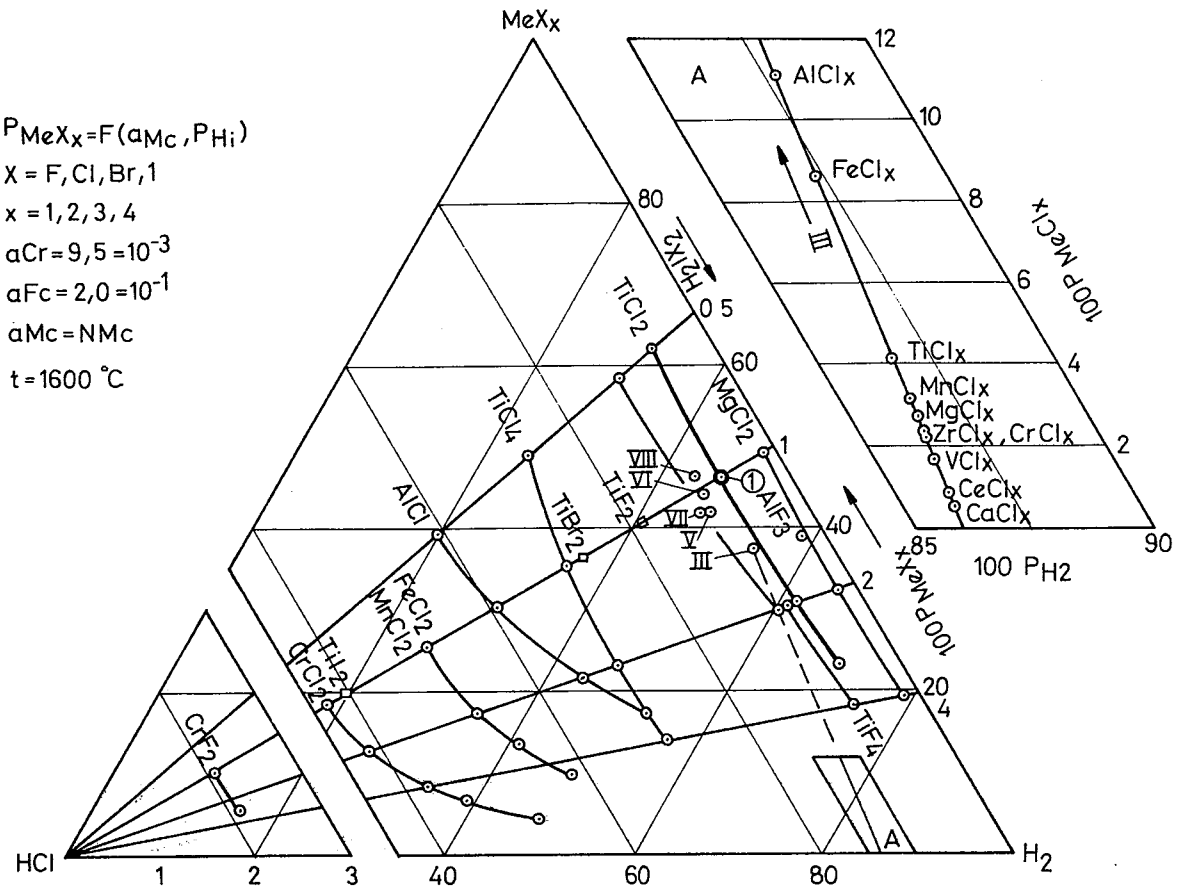

FIG. 4 shows the compositions of the gas phases produced in the evaporation of certain halides covered by the process, calculated by using the balance constants in FIG. 1. The halides have been treated as independent ones. The activities of chromium, iron, and manganese in the ferrochromium melt are approximately known, and thus, they have been used in the calculations. The molar ratios have been used as the activities of the other metals. It is naturally a fact that the activities of these metals, also, are affected by the carbon and chromium contents of the melt. According to FIG. 1, the halide formation balance constants of most of the metals which come in question are very high, so that even considerable lowerings of the activity values cannot prevent a high halide formation rate. The analysis of the ferrochromium corresponding to FIG. 4 — % by weight (%by atomic weight)/Me — was as follows: 52.10 (42.31)/Cr; 37.90 (28.65)/Fe; 7.00 (24.61)/C; 0.18 (0.28)/Al; 0.05 (0.05)/Ca; 0.19 (0.33)/Mg; 0.26 (0.20)/Mn; 1.60 (2.41)/Si, and 0.80 (0.71)/Ti. The calculation corresponds to the halide balances at 1600° C. The independent halide balances shown in FIG. 4 correspond to the result which can be estimated even from FIG. 1. The balance indicated by point 1 in the figure represents the real chloride mixture balance at 1600° C in regard to the dichlorides of iron, chromium, and titanium. The chromium chloride and iron chloride vapors produced in the treatment of ferrochromium react with the molten titanium according to the balances in FIG. 1 (e.g., $CrCl_2$ (g) + Ti (l)$\lessgtr$$TiCl_2$ (g) + Cr (l)), in which case their ratios of the total pressure are also lowered. The composition (% by vol.) of the chloride vapor corresponding to point 1 is as follows: $CrCl_2$ 0.23, $FeCl_2$ 0.71, and $TiCl_2$ 99.06. It is natural that a result quite as advantageous is not obtained on a large technological scale because the dispersion of the gas mixture in the melt and the reaction delay cannot always be controlled widely enough.

When the delay period of the gas mixture $H_2 + Cl_2$ in the melt is regulated as long as possible, a considerable chlorine surplus can be used in the gas mixture because then the chromium chlorides and the iron chlorides have enough time to react with those metals of the melt of which the free energy of chloride formation is more negative than that of the former.

FIG. 4 shows the calculated balances of the fluorides, bromides, and iodides of certain metals. It must be noted that the fluoride of chromium is more unstable than its chloride. The formation rate of bromides and fluorides of chromium with a hydrogen + halogen mixture is very low (1600° C: kp/$MeX_2$; 0,78/$CrI_2$, 0.33/$CrBr_2$, and 4.96/$FeI_2$, 9.67 × $10^{-2}$/$FeBr_2$). The formation rate of bromides and iodides of titanium is still advantageous for the process.

The balance constants corresponding to the formation of monohalides of copper are as follows according to FIG. 1: (1600° C-kp/1400° C-kp/CuX) 8.61 × $10^{-3}$/8.42 × $10^{-4}$/CuCl; 1.51/3.61 × $10^{-1}$/CuBr and 13.91/10.02/CuI. Thus, the copper contained in the ferrochromium melt can be assumed to be transferred at least partly as a bromide and especially as iodide into the vapor phase. In the trial processes it was noted that the copper content in the melt lowered significantly even when using a $H_2 + Cl_2$ gas mixture in spite of the disadvantageousness of the balance constant (and of the low copper content in the melt —~0.01 Cu —). This is obviously partly due to the increasing effect of the alloying elements (Cr, Fe, C) on the copper acitivity in the melt and partly to the fact that the halide formation is strongly exothermal, so that owing to a local rise in the temperature of the melt the balance conditions of copper chloride formation are improved (and the copper which has ended up in the gas phase will not return to the melt even when the temperature of the gases is lowered). However, it is often advantageous not to remove the copper from the melt before the other impurities have been removed (easily decomposing salts, e.g., $NH_4Br$, $NH_4I$, etc. are suitable for the treatment).

The atomic numbers of the halogens contained in the halide compounds of the gas phase are not precisely known under the conditions of the process. However, it can be noted generally that the presence of both carbon and, especially, hydrogen prevents the formation of multiatomic halides (for example, hydrogen completely prevents the formation of $Cr^{+3}$ chlorides and $Fe^{+3}$ chlorides).

In this discussion, even the halides with boiling points above 1600° C have been treated as being in a gaseous state. However, the metal amounts present in a ferrochromium melt are usually so small that the vapor pressure of their molten phases does not surpass the saturation pressure. If there is a great amount of metals of which the halides have high boiling points, a salt melt is formed on the surface of the melt. The removal of the metals from the melt is not complicated thereby.

The effect of a selective halogenation of molten ferrochromium on the sulfur content of the melt is discussed below. A considerable lowering of the sulfur content of the melt took place regularly under the trial conditions. Because the halides of sulfur are not stable under the conditions of the process, the lowering of the sulfur content of the melt can be deduced from the balance $$H_2\,(g) + \overline{S}_{Fe-Cr} \lessgtr H_2S\,(g) \qquad (5)$$

The balance constant of the reaction within the temperature range of 1520° –1799° C is known to be of the form $$\log k = -2150/T\,(°K) - 1.429 \qquad (6)$$

Some of the alloying elements of ferrochromium which increase the activity of sulfur are C, Si, P, Al, and some of those which decrease it, Cr, Ti, S, Mn, Cu.

It is assumed that the composition (% by weight) of the ferrochromium melt is as follows: Cr 55.0, Si 1.6, C 7.0, and S 0.10 and, devoid of carbon, respectively Cr 59.0, Si 1.7, and S 0.11.

The activity of sulfur in the melt is expressed by $a_s = f_s\,x$ (% S), in which $\log f_s = \log f_s^{(s)} + \log f_s^{(Cr)} + \log f_s^{(Si)} + \log f_s^{(C)}$. In this case the individual effects of the alloying elements are approximately as follows: $\mathrm{Log} f_s^{(S)} = -0.0285$ (% S), $\log f_s^{CR} = -0.0111$ (% Cr), $\log f_s^{(C)} = -0.80 + 0.3000$ (% C) and $\log f_s^{(Si)} = +0.0800$ (% Si).

Thus, the value obtained for the activity coefficient of the sulfur in the ferrochromium melt is $\log f_S = -0.520$, i.e., $f_S = 0.302$, and the activity is then $a_s = 0.33$. Respectively, the values obtained for carboniferous ferrochromium are $\log f_s = 0.815$, i.e., $f_s = 6.53$ and $a_s = 0.653$. Thus, by using the balance constant of equation (6) at 1600° C, the ratio value obtained is $H_2S/H_2 = 1.73 \times 10^{-3}$. In the latter case the value obtained for the hydrogen sulfide of the gas phase in a balanced state with an initial hydrogen pressure of 1 atm is $H_2S = 0.17$ % by vol. The effect of carbon on the activity value of sulfur is thus about 20-fold in the discussed case, so that lowering the sulfur rate in the molten ferrochromium is possible with a very high $H_2S/H_2$ ratio.

Figure 5:
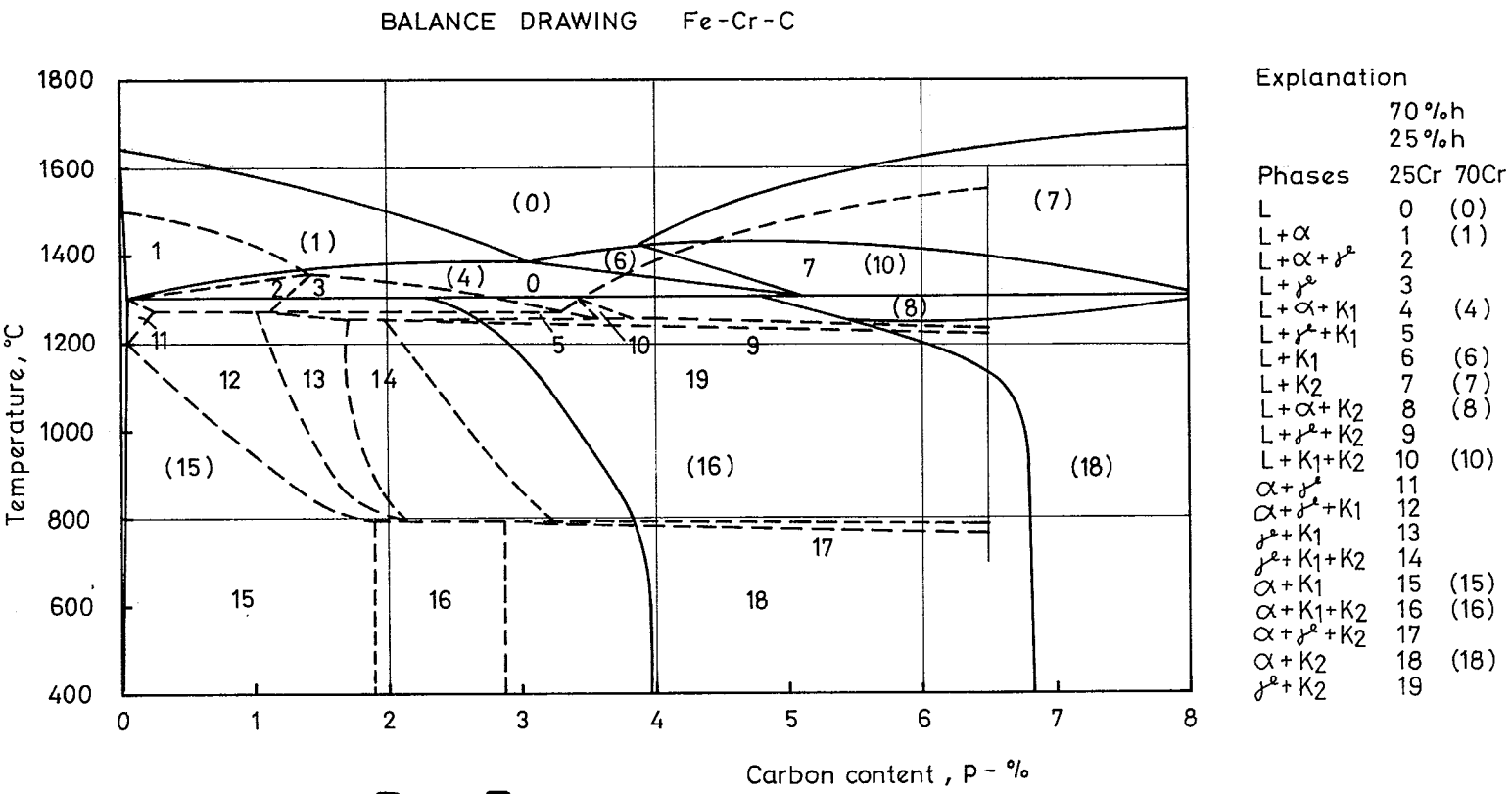

FIG. 5 shows the sections of the Fe-Cr-C system with the chromium contents of Cr 25 % and 75 %. The temperature of the solidus surfaces which determine the lowest operation temperatures (1250°–1400° C) of the new halogenation process can be determined from the figure as a function of the carbon content.

When sulfur is also removed from ferrochromium melt with hydrogen after the halogenation, the result when the melt cools is, according to FIG. 5, a balance range which covers a very wide temperature range, where the $Me_7C_3$ carbide separates from the melt while the C and Cr contents of the melt are simultaneously lowered. At the temperature of 1450° C after the separation of the $Me_7C_3$ carbide, the rate of the molten phase of the said carboniferous ferrochromium is about 41 % by weight and its composition approximately Cr 42.4, Fe 53.3, C 4.3, Si 3.9, and S 0.24. The values obtained for the sulfur activity coefficient and activity with this melt composition are $\log f_s = 0.320$, i.e., $f_s = 2.09$ and $a_s = 0.502$. Thus, the value of the sulfur activity in the molten phase does not change much from the previously given value because the carbon rate, which raises its value, is lowered, but on the other hand, the sulfur content of the phase is increased. If the melt still contains a great deal of, for example, titanium and zirconium, the sulfides TiS and $Zr_2S_3$ or their carbosulfides, $MeS_2C_2$, may separate from the melt when the temperature is lowered, depending on the sulfur and carbon contents, in which case the activity values change and the removal of sulfur from the molten phase may be complicated.

For reasons of analogy, all the metals covered by the process are not discussed in this connection. Generally speaking, a selective halogenation is very successful in regard to the following groups of the periodic table: I*a*; II*a* and *b*; III*a* (also numbers 57-71); IV*a*; IV*b*: Ge, Si, (Pb); V*a*; VI*a*: (Mo), (W), U; and VII*b*: Mn.

When performing halogenation trials with $F_2$— and $Cl_2$—$H_2$ gas mixtures, the apparatus used was a conventional metallurgical ladle with a capacity of about 15 tons and with the following dimensions: diameter 1.27 m, height 1.69 m, and volume 2.2 $m^3$.

Five one-inch-diameter pipes of which each was provided with perforate graphite nozzles at the lower end when used for feeding the halogenation gas into the melt.

The ferrochromium melt to be treated was taken directly from a productional light-arc furnace. Because the halogenation process is exothermal, no cover was used on the ladle, but the gases and the halide vapors contained in them were sucked from the ladle into an assembly funnel which was provided with cooling pipes for condensating the halides. The hydrogen was usually burned at a point after the pipes. The environmental harmfulness of the process gases and countermeasures to it were investigated with a few trials. The additional apparatus then used consisted of a separate combustion chamber where methane was fed into the partly cooled gas phase to partly carburet the halides. A coke bed and an aluminum bath were also used for the refinement of the waste gases containing halides and hydrogen halide.

The measurements of the temperatures of the products were usually imprecise and then the temperature was observed by calculating the heat balance of the process. The enthalpy values of halides at high temperatures are, however, partly unknown, so that there may be errors in the mean temperatures obtained for the products by the above method.

Some of the halogenation trials were carried out in an electric ladle with a cover and with a capacity of about a ton. When needed, standard electric power was fed to it at a rate corresponding to the normal calculated and measured heat losses of the ladle.

EXAMPLES

A molten ferrochromium carbure taken from a conventional process was used in the halogenation trials. The hydrogen and halogens used were technological. Because the ferrochromium did not contain all the alloying elements covered by the process, they were added to the melt at the desired rates either as mixtures or as carbides.

The rates of the feed melt, the product melts, and the halides, their analyses, and the heat balances of the various trial cases are given in Tables 1–4. The analyses of the halides in the balances are not precise because some of the metallic components were calculated from the balance differences (Ti, Al). This was because the condensation of the halides took place at different points of the pipe system in the trial systems or took place as a halide only partly or not at all. The condensates were detached from the various parts of the pipe system, mixed together, and analyzed. The final stage of the blast was analyzed by determining the $HCl/H_2$ ratio in the exhaust gas, which is not a precise method. An attempt was made to keep the surplus feed gas under 10 % by weight.

EXAMPLES I-III

In Examples I and II, ferrochromium melts with similar analyses were used. The initial temperature of the melts was 1600° C. In Example I, the melt was blasted with an equimolar $H_2 + Cl_2$ mixture for about 45 minutes. In Example II, the melt was blasted for about 30 minutes with a gas mixture in which the $H_2/Cl_2$ ratio was 2. It can be noted from Balance Tables 1–3 that in the trial run of Example I, the evaporation of chromium and iron was about 50 % less than in the trial run corresponding to Example II. The Cr/Fe ratio in the evaporation discharge was 0.38 in Example I and 0.47 in Example II. It can be noted from the heat balances of Table 4 that in Example II, in spite of a shorter treatment period (heat loss grows as a function of time) the temperature of the melt lowered more than in Example I. This was because halogenation was strongly exothermal and, for example, the chlorination of chromium was considerably greater in Example I than in Example II.

In the trial according to Example III, metals Al, Ce, and Zr were added to a productional ferrochromium melt in ratios corresponding to the analysis of Balance Table 1 (Zr, Nb, Ta, lanthanides, etc. often end up in ferrochromium melt from slag additions and scrap metal). The blasting of the melt took place at the initial temperature of 1600° C with a gas mixture in which the ratio $H_2/Cl_2$ was 1.5.

It is noted from the balance table that the removal of impurities was, as in the previous examples, almost complete, i.e., calculated from the feed rates (%) as follows: Ti 89, Al 90, Ce 93, and Zr 87. The evaporation of chromium as a chloride was slightly lower than the respective result in Example II, which was obviously due to the increased delay period of gas in the metal. The Cr/Fe ratio of the evaporation discharge was 0.24. It can be noted from the heat balance of Table 4 that the temperature of the melt increased considerably as a result of the blast, which is due especially to the strongly exothermal nature of the chlorination of the metals Al and Zr.

The total composition of the halide-hydrochloride-hydrogen mixture corresponding to Example III has been calculated for Table 4. The calculation took place on the basis of the weight and metal analyses of the obtained combined halide amount. The numbers of halogen atoms in the halide components are uncertain, especially in the cooled mixture, (indication: $MeCl_x$). The component rates at point III in FIG. 4 corresponding to the gross composition, transformed into partial pressures, can be seen, the $HCl/H_2$ ratio being constant, in section A of the system $MeCl_x$—HCl—$H_2$.

According to Material Balance Tables 1–2, the sulfur content of the initial ferrochromium melt in the trial corresponding to Example III lowered from 0.15 % to 0.10 %. This lowering of the sulfur content prerequires a much higher $H_2S/H_2$ ratio compared with the calculation of the process description taking into account the hydrogen rate used for the halogenation. The mixing effect of the produced metal halides on the melt is considerable, so obviously the removal of sulfur into the gas phase also takes place with $H_2S/H_2$ ratios close to the balance.

The value of the effect parameter of carbon, which strongly increases the activity coefficient of sulfur, is relatively well known, but the values of the effect parameter of chromium, which lowers the activity, are imprecise. The validity range of the parameter value used in the process description extends only to a chromium content value of about Cr 20 % of the melt. Parameter values with much lower absolute values have been obtained in investigations with higher chromium contents than this. It is known that chromium causes a molten state solubility gap in the Fe-S system, i.e., the melt is divided into two metal melt layers which separate from each other, one sulfur-rich and the other sulfur-poor. Many alloying elements of the melt (e.g., B, C, P, Si, Su, Al, Ce, Mn, Ti, Zr) expand this solubility gap, for example, in the direction of low sulfur contents. Owing to the high chromium content of the melt investigated, it is possible that melt-melt separation or at least (low sulfur content) certain atom grouping for separation may take place in the melt. The chromium effect parameter used, which does not extend to the heterogen range, may thus have too high an absolute value and the calculated sulfur activity may be too low under the said conditions. There are obviously a number of other reasons for the greater than calculated removal of sulfur, but there is no reason to discuss them in this connection. When removing, after halogenation, sulfur from the melt to a content of S-0.05% by blasting the melt with hydrogen, the activity values of sulfur in the melt were noted to be sufficient, and the requisite hydrogen rate per one ton of melt was about 150 $m^3$. Thus, by means of a suitable circulation process, by removing the produced amount of $H_2S$ from the hydrogen (metal or salt bath, metal chips, etc) even small amounts of sulfur can be removed from a ferrochromium melt which has a high carbon content.

EXAMPLES IV and V

In the trials according to Examples IV and V, metals Si, B, Ti, and Ce were mixed into an already purified ferrochromium melt. The melts thus obtained were treated with fluorine in the presence of hydrogen ($H_2/F_2 = 1.15$). In Example IV, a ferrochromium corresponding to that in the previous examples was used, but in Example V the chromium content of the melt was higher than in the previous ones. The material and heat balances corresponding to the examples are given in Tables 1–4.

It can be noted from the material balances that silicon and boron were also removed from the melt. The strongly exothermal nature of halogenation, which causes a very strong rise in the temperature of the process products, can be noted from the heat balances corresponding to Examples IV and V. Although a steam pipe was used for binding the surplus heat from the ladle, an increase of temperature took place in the products. The heat balance is only approximate in regard to the heat rates. In heat balance example V B, melt was cooled with nitrogen. Let it be mentioned that the use of a salt melt (alkali fluoride + $CaF_2$ + CaO; $CaF_2$/Cao = 4), by melting it in the ladle, does not have a great heat binding effect in the system. The salt rate of 12 kg/a ton of ferrochromium melt (corresponding to a layer of 2 cm) lowers the temperature of the products only some 40°–50° C. Alakli-halide-containing (Cl, F) earth alkali salts, of which the melting point range has been raised by using earth alkali oxides or aluminum oxide, are suitable for use at such high temperatures, although their ability to dissolve halides is not great.

EXAMPLES VI–IX

Examples VI–IX illustrate the effects of the various components of the halogen group in a ferrochromium melt when metals Ti, Nd, Cu, and Ta have been added to an already purified melt. The material balances corresponding to the examples are given in Tables 1–3.

It can be noted from the material balances that the tantalum was removed from the ferrochromium melt as fluorides and the copper was removed partly as bromides and iodides. Let it be mentioned that carbon raises the copper activity in the melt by about a decimal, but nevertheless, this activity is very low. In the evaporation of chromium and iron, an increase of the selectivity of halogenation can be already noted when the periodic table number of the halogen grows (with slight exceptions). FIG. 4 shows, on the basis of the metal and gas phase analyses, the points corresponding to the total composition of the gas phases obtained by using different halogens. A deviation of the points from each other can be noted in the figure; this deviation is obviously due to the differences between the halogen contents of the produced halides.

The heat loss values of the heat balances corresponding to the examples, calculated from the previous values of the large ladle (corresponding to the feed rates) are indicated in parentheses in the balances of Table 4 as are the temperatures of the products obtained by using these heat losses.

EXAMPLES X and XI

The discussed new process has been developed mainly for the treatment of ferrochromium, but it is also suitable for many ferrous alloy melts. Some of the alloys that can be mentioned in this connection are the ferrous alloys of tungsten, molybdenum, niobium, and tantalum. Examples X and XI correspond to a chlorinating treatment of ferrous alloys of molybdenum and niobium, carried out with a one-ton batch in an electric furnace. The halogenation process is applicable to both carbon-free and carboniferous alloys of these metals.

The said metals tend to form mainly comparable to the activity of chromium. When using halogens in the presence of hydrogen, the balance constants corresponding to the halide formation of these metals are, however, so low that the evaporation discharge of the basic metals is very small even when treating carbon-free alloys. It can be noted from the material and heat balances (Tables 1–4) corresponding to Examples X and XI that the chlorinating treatment of ferromolybdenum and ferroniobium in the presence of hydrogen is analogous by its results to the previous examples.

An attempt has been made in the specification and examples of the process to include in the discussion one or more metals from each group of materials covered by the new process. Since the exothermal nature of the process is determined as a function of the quality and the amount of the components, it is clear that the apparatuses to be used in connection with the process can be varied in many ways. Usually no furnace systems are required in the materialization of the process, but naturally they can be used in process control and even otherwise when necessary. The use of different halogens alone or as mixtures in the entire process, or partly only in regard to one impurity component, also offers a number of possibilities for variation. If sulfur is also removed when refining a ferrous alloy, the bulk of the sulfur can be removed either before or after the removal of the other impurities, depending on whether the exothermal nature of the halogenation or the properties of the alloying elements are utilized or not. The use of the hydrogen circulation process also offers numerous different adjustment possibilities both in the halogenation and in the removal of sulfur.

Table 1.

| Balance component | Amounts and analyses of metal melts to be processed — Example I-II | III | IV | V | VI-IX | X | XI |
|---|---|---|---|---|---|---|---|
| Amount of material, kg | 10000 | 10000 | 10000 | 10000 | 1000 | 1000 | 1000 |
| Analysis, % by weight | | | | | | | |
| Cr | 52.60 | 52.10 | 52.69 | 64.20 | 53.29 | — | 0.10 |
| Mo | — | — | — | — | — | 55.20 | — |
| Nb | — | — | — | — | — | — | 65.01 |
| Fe | 37.20 | 37.00 | 38.31 | 27.65 | 38.77 | 38.80 | 29.30 |
| Ti | 0.40 | 0.27 | 0.39 | 0.39 | 0.25 | 0.10 | 0.80 |
| C | 7.20 | 7.00 | 7.16 | 6.40 | 7.16 | 2.50 | 0.10 |
| Al | 0.10 | 0.40 | — | — | — | 0.80 | 0.80 |
| B | — | — | 0.11 | 0.10 | — | — | — |
| Ca | 0.10 | 0.05 | — | — | — | — | — |
| Ce | — | 0.15 | 0.24 | 0.24 | — | — | 0.10 |
| Co + Ni | 0.21 | 0.20 | — | — | — | — | — |
| Cu | 0.007 | 0.01 | — | — | 0.12 | 0.20 | — |
| Mg | 0.05 | 0.19 | — | — | | — | — |
| Mn | 0.10 | 0.26 | — | — | | 0.75 | 0.50 |
| Nd | — | — | — | — | 0.10 | — | — |
| P | 0.017 | — | — | — | — | 0.05 | 0.05 |
| S | 0.13 | 0.15 | — | — | — | 0.05 | 0.10 |
| Si | 1.80 | 1.60 | 1.00 | 1.00 | — | 1.00 | 0.50 |
| Sn | — | — | — | — | — | 0.15 | 0.25 |
| Ta | — | — | — | — | 0.21 | — | 2.10 |
| W | — | — | — | — | — | 0.20 | 0.15 |
| V | — | 0.18 | — | — | — | — | — |
| Zr | — | 0.30 | — | — | — | — | — |

Table 2.

| Balance component | Amounts and analyses of halogenated metal melts — Example I | II | III | IV | V |
|---|---|---|---|---|---|
| Amount of material, kg | 9735 | 9876 | 9780 | 9809 | 9806 |
| Analysis, % by weight | | | | | |
| Cr | 53.49 | 53.10 | 53.13 | 53.56 | 65.27 |
| Fe | 36.80 | 37.32 | 37.24 | 38.88 | 28.10 |
| Ti | 0.02 | 0.02 | 0.03 | 0.02 | 0.02 |
| C | 7.40 | 7.29 | 7.16 | 7.30 | 6.53 |
| Al | 0.01 | 0.01 | 0.04 | — | — |
| B | — | — | — | 0.01 | 0.01 |
| Ca | 0.06 | 0.06 | 0.03 | — | — |
| Ce | — | — | 0.01 | 0.01 | 0.01 |
| Co + Ni | 0.21 | 0.21 | 0.20 | — | — |
| Cu | 0.005 | 0.005 | 0.01 | — | — |
| Mg | 0.01 | 0.01 | 0.02 | — | — |
| Mn | 0.01 | 0.01 | 0.11 | — | — |
| P | 0.015 | 0.016 | — | — | — |
| S | 0.10 | 0.09 | 0.10 | — | — |
| Si | 1.85 | 1.82 | 1.64 | 0.10 | 0.05 |
| V | — | — | 0.08 | — | — |
| Zr | — | — | 0.04 | — | — |

| Balance component | Example VI | VII | VIII | IX | X | XI |
|---|---|---|---|---|---|---|
| Amount of material, kg | 992 | 991 | 992 | 993 | 986 | 977 |
| Analysis, % by weight | | | | | | |
| Cr | 53.58 | 53.65 | 53.59 | 53.62 | — | 0.08 |
| Mo | — | — | — | — | 55.79 | |
| Nb | — | — | — | — | — | 66.37 |
| Fe | 38.92 | 38.69 | 39.00 | 39.05 | 39.15 | 29.78 |
| Ti | 0.01 | 0.02 | 0.01 | 0.01 | 0.01 | — |
| C | 7.22 | 7.23 | 7.22 | 7.21 | 2.54 | 0.10 |

Table 2.-continued

| | Amounts and analyses of halogenated metal melts | | | | | |
|---|---|---|---|---|---|---|
| Al | — | — | — | — | 0.05 | 0.05 |
| Ce | — | — | — | — | — | 0.01 |
| Cu | 0.12 | 0.11 | 0.04 | 0.00 | 0.20 | — |
| Mn | — | — | — | — | 0.66 | 0.41 |
| Nd | 0.01 | 0.01 | 0.01 | 0.00 | — | — |
| P | — | — | — | — | 0.05 | 0.05 |
| S | — | — | — | — | 0.04 | 0.05 |
| Si | — | — | — | — | 1.01 | 0.51 |
| Sn | — | — | — | — | 0.10 | 0.10 |
| Ta | 0.03 | 0.18 | 0.03 | 0.01 | — | 2.13 |
| W | — | — | — | — | 0.18 | 0.15 |

Table 3.

| | Amounts and analyses of halides | | | | |
|---|---|---|---|---|---|
| | Example | | | | |
| Balance component | I | II | III | IV | V |
| Amount of material, kg | 600 | 279 | 507 | 562 | 573 |
| Analysis, % by weight | | | | | |
| Cr | 8.8 | 5.7 | 2.8 | 2.7 | 3.5 |
| Fe | 23.0 | 12.6 | 11.4 | 3.0 | 1.7 |
| Ti | 6.3 | 13.6 | 4.7 | 6.5 | 6.5 |
| Al | 1.5 | 3.2 | 7.1 | — | — |
| B | — | — | — | 1.8 | 1.6 |
| Ca | 0.7 | 1.4 | 0.4 | — | — |
| Ce | — | — | 2.8 | 4.1 | 4.0 |
| Cu | 0.03 | 0.07 | — | — | — |
| Mg | 0.7 | 1.4 | 4.1 | — | — |
| Mn | 1.5 | 3.2 | 1.6 | — | — |
| Si | — | — | — | (16.0) | (16.6) |
| V | — | — | 2.0 | — | — |
| Zr | — | — | 5.1 | — | — |

| | Example | | | | | |
|---|---|---|---|---|---|---|
| Balance component | VI | VII | VIII | IX | X | XI |
| Amount of material, kg | 14 | 21 | 28 | 30 | 31 | 30 |
| Analysis, % by weight | | | | | | |
| Cr | 10.6 | 7.0 | 5.4 | 1.7 | — | 0.4 |
| Mo | — | — | — | — | 6.5 | — |
| Nb | — | — | — | — | — | 3.2 |
| Fe | 12.0 | 21.0 | 3.6 | 0 | 6.5 | 4.0 |
| Ti | 17.0 | 10.7 | 8.6 | 8.0 | 2.9 | 14.9 |
| Al | — | — | — | — | 24.2 | 14.9 |
| Ce | — | — | — | — | — | 1.8 |
| Cu | — | — | 2.9 | 4.0 | — | — |
| Mn | — | — | — | — | 3.2 | 2.0 |
| Nd | 6.4 | 4.2 | 3.2 | 3.3 | — | — |
| Sn | — | — | — | — | 1.6 | 3.0 |
| Ta | 12.7 | 1.4 | 6.4 | 6.6 | — | 0.4 |
| W | — | — | — | — | 0.7 | — |

Table 4.

| | Heat balances of halogenation processes | | |
|---|---|---|---|
| Heat balance component | Amount of material, kg | Temperature °C | Amount of heat, Mcal |
| Example I | | | |
| Feed: | | | |
| Fe—Cr—C melt | 10000 | 1600 | 24901 |
| $Cl_2 + H_2$ gas | 445 | 25 | 353 |
| Total feed | 10445 | — | 25254 |
| Product | | | |
| Fe—Cr—C melt | 9735 | 1570 | 24117 |
| Mc chloride | 602 | 1570 | 502 |
| $HCl + H_2$ gas | 109 | 1570 | 462 |
| Heat losses | — | — | 173 |
| Total product | 10446 | — | 25254 |
| Example II | | | |
| Feed: | | | |
| Fe—Cr—C melt | 10000 | 1600 | 24819 |
| $Cl_2 + H_2$ gas | 204 | 25 | 315 |
| Total feed | 10204 | — | 25134 |
| Product | | | |
| Fe—Cr—C melt | 9876 | 1537 | 24385 |
| Mc chloride | 279 | 1537 | 232 |
| $HCl + H_2$ gas | 50 | 1537 | 404 |
| Heat losses | — | — | 115 |
| Total product | 10205 | — | 25136 |
| Example III | | | |
| Feed: | | | |
| Fe—Cr—C melt | 10000 | 1600 | 24936 |

Table 4.-continued

| | Heat balances of halogenation processes | | |
|---|---|---|---|
| Heat balance component | Amount of material, kg | Temperature °C | Amount of heat, Mcal |
| $Cl_2 + H_2$ gas | 345 | 25 | 404 |
| Total feed | 10345 | — | 25340 |
| Product | | | |
| Fe—Cr—C melt | 9780 | 1677 | 24278 |
| Mc chloride | 507 | 1677 | 329 |
| $HCl + H_2$ gas | 63 | 1677 | 503 |
| Heat losses | — | — | 230 |
| Total product | 10350 | — | 25340 |
| Example IV | | | |
| Feed: | | | |
| Fe—Cr—C melt | 10000 | 1600 | 24285 |
| $F_2 + H_2$ gas | 425 | 25 | 613 |
| Total feed | 10425 | — | 24898 |
| Product | | | |
| Fe—Cr—C melt | 9809 | 1650 | 23158 |
| $HF + H_2$ gas | 54 | 1650 | 642 |
| Mc fluoride | 562 | 1650 | −464 |
| Heat losses | — | — | (1562) |
| Total product | 10425 | — | 24898 |
| Example V A | | | |
| Feed: | | | |
| Fe—Cr—C melt | 10000 | 1600 | 25886 |
| $F_2 + H_2$ gas | 447 | 25 | 740 |
| Total feed | 10447 | — | 26626 |
| Product | | | |

Table 4.-continued

Heat balances of halogenation processes

| Heat balance component | Amount of material, kg | Temperature °C | Amount of heat, Mcal |
|---|---|---|---|
| Fe—Cr—C melt | 9806 | 1650 | 24865 |
| Me flouride | 573 | 1650 | −470 |
| HF + $H_2$ gas | 68 | 1650 | 764 |
| Heat losses | — | — | (1467) |
| Total product | 10447 | — | 26626 |
| Example V B | | | |
| Total feed | 12557 | — | 26626 |
| Product | | | |
| Fe—Cr—C melt | 9806 | 1700 | 24972 |
| Me fluoride | 573 | 1700 | −463 |
| HF + $H_2$ gas | 68 | 1700 | 769 |
| $N_2$ gas | 2130 | 1700 | 1003 |
| Heat losses | — | — | 345 |
| Total product | 12577 | — | 26626 |
| Example VI | | | |
| Feed | | | |
| Fe—Cr—C melt | 1000.0 | 1600 | 2353 |
| $F_2$ + $H_2$ gas | 6.9 | 25 | 10 |
| Total feed | 1006.9 | — | 2363 |
| Product | | | |
| Fe—Cr—C melt | 991.7 | 1640 | 2338 |
| Me fluoride | 14.2 | 1640 | 15 |
| MF + $H_2$ gas | 1.0 | 1640 | 10 |
| Total product | 1006.9 | — | 2363 |
| (Heat losses) | | (1536) | (23) |
| Example VII | | | |
| Feed | | | |
| Fe—Cr—C melt | 1000.0 | 1600 | 2353 |
| $Cl_2$ + $H_2$ gas | 13.6 | 25 | 11 |
| Total feed | 1013.6 | — | 2364 |
| Product | | | |
| Fe—Cr—C melt | 990.5 | 1620 | 2332 |
| Me chloride | 21.4 | 1620 | 19 |
| HCl + $H_2$ gas | 1.7 | 1620 | 13 |
| Total product | 1013.6 | — | 2364 |
| (Heat losses) | | (1515) | (23) |
| Example VIII | | | |
| Feed | | | |
| Fe—Cr—C melt | 1000.0 | 1600 | 2353 |
| $Br_2$ + $H_2$ gas | 22.0 | 25 | 8 |
| Total feed | 1022.0 | — | 2361 |
| Product | | | |
| Fe—Cr—C melt | 991.6 | 1634 | 2337 |
| Me bromide | 28.0 | 1634 | 15 |
| HBr + $H_2$ gas | 2.4 | 1634 | 9 |
| Total product | 1022.0 | — | 2361 |
| (Heat losses) | | (1529) | (23) |
| Example IX | | | |
| Feed | | | |
| Fe—Cr—C melt | 1000.0 | 1600 | 2353 |
| $J_2$ + $H_2$ gas | 25.8 | 25 | 6 |
| Total feed | 1025.8 | — | 2359 |
| Product | | | |
| Fe—Cr—C melt | 992.9 | 1598 | 2333 |
| Me-Iodide | 30.1 | 1598 | 19 |
| HJ + $H_2$ gas | 2.8 | 1598 | 7 |
| Total product | 1025.8 | — | 2359 |
| (Heat losses) | | (1493) | (23) |
| Example X | | | |
| Feed | | | |
| Fe—Mo—C melt | 1000 | 1600 | 1651 |
| $H_2$ + $Cl_2$ gas | 19 | 25 | 15 |
| Total feed | 1019 | — | 1666 |
| Product | | | |
| Fe—Mo—C melt | 986 | 1700 | 1597 |
| Me chloride | 31 | 1700 | 24 |
| HCl + $H_2$ gas | 2 | 1700 | 18 |
| Heat losses | — | — | 28 |
| Total product | 1019 | — | 1667 |

Table 4.-continued

Heat balances of halogenation processes

| Heat balance component | Amount of material, kg | Temperature °C | Amount of heat, Mcal |
|---|---|---|---|
| Example XI | | | |
| Feed | | | |
| Fe—Nb melt | 1000 | 1600 | 2344 |
| $H_2$ + $Cl_2$ gas | 30 | 25 | 24 |
| Total feed | 1030 | — | 2368 |
| Product | | | |
| Fe—Nb melt | 977 | 1700 | 2243 |
| Mo chloride | 50 | 1700 | 60 |
| HCl + $H_2$ gas | — | 1700 | 28 |
| Heat losses | — | — | 37 |
| Total product | 1029 | — | 2368 |

What is claimed is:

1. An improved process for refining an impure alloy containing a base metal and at least one of the metals iron, cobalt and nickel, in which the base metal tends to form a carbide, wherein a mixture of at least one halogen-containing material and hydrogen is added to a smelt of the alloy in which smelt the carbon content is between 4% and 8% in order to lower activity of the base metal, forming metal halides of impurities and withdrawing impurities in the form of their metal halides from the smelt.

2. The process of claim 1 wherein said halogen containing material comprises at least one substance of the formula $X_2$, HX or $NH_4X$ in which X represents a halogen atom.

3. A process for refining a carbonaceous alloy containing as its base metal one or more of the metals Cr, Mo, W, Nb and Ta; about 4% to about 8% C; less than about 4% impurities; the remainder being one or more of the metals iron, cobalt or nickel, which process comprises contacting said alloy as a smelt with a mixture of hydrogen and at least one halogen compound to form metal halides and withdrawing impurities as metal halides.

4. The process of claim 3 wherein said mixture contacting said alloy smelt is 0.7 to 4.5% $H_2$ and at least one hydrohalide, calculated on the weight of smelt feed.

5. The process of claim 3 comprising contacting the alloy smelt with a mixture of $H_2$ and at least one hydrohalide over a period of from about 30 minutes to about 45 minutes.

6. The process of claim 3 wherein said mixture contacting the alloy smelt comprises $H_2$ and at least one hydrohalide and wherein said alloy smelt has an initial temperature of about 1600° C.

7. The process of claim 3 wherein the alloy smelt is a smelt of ferrochromium and the mixture contacting the smelt contains $H_2$ and $Cl_2$ in a molar ratio of 1:2.

8. The process of claim 3 wherein the base metal of the alloy smelt is chromium, said smelt containing no more than about 65% Cr, and wherein said remainder being iron.

9. The process of claim 3 wherein the base metal of the alloy smelt is molybdenum said remainder being iron.

10. The process of claim 3 wherein the base metal is niobium, said remainder consisting substantially or iron.

* * * * *

UNITED STATES PATENT AND TRADEMARK OFFICE

CERTIFICATE OF CORRECTION

PATENT NO. : 4,006,013

DATED : February 1, 1977

INVENTOR(S) : Simo Antero Iivari Mäkipirtti et al

It is certified that error appears in the above–identified patent and that said Letters Patent are hereby corrected as shown below:

Col. 3, line 52

"the ferrochromium and by" should be

--the ferrochromium melt and by--

Col. 16, line 63 - Claim 10.:

"remainder consisting substantially or iron."

should be --remainder being iron.--

Signed and Sealed this

Seventeenth Day of May 1977

[SEAL]

*Attest:*

RUTH C. MASON
*Attesting Officer*

C. MARSHALL DANN
*Commissioner of Patents and Trademarks*